US011577119B2

(12) United States Patent
Williams

(10) Patent No.: US 11,577,119 B2
(45) Date of Patent: Feb. 14, 2023

(54) MODULAR CABLE MACHINE EXERCISE SYSTEM

(71) Applicant: Gregory W. Williams, Centerville, OH (US)

(72) Inventor: Gregory W. Williams, Centerville, OH (US)

( * ) Notice: Subject to any disclaimer, the term of this patent is extended or adjusted under 35 U.S.C. 154(b) by 54 days.

(21) Appl. No.: 17/159,669

(22) Filed: Jan. 27, 2021

(65) Prior Publication Data

US 2022/0233909 A1 Jul. 28, 2022

(51) Int. Cl.
*A63B 21/00* (2006.01)
*A63B 21/062* (2006.01)

(52) U.S. Cl.
CPC ..... *A63B 21/156* (2013.01); *A63B 21/0628* (2015.10); *A63B 21/151* (2013.01); *A63B 21/154* (2013.01); *A63B 2225/09* (2013.01); *A63B 2225/093* (2013.01)

(58) Field of Classification Search
CPC ..... A63B 21/018; A63B 21/06; A63B 21/08; A63B 21/062; A63B 21/0624; A63B 21/0628; A63B 21/0632; A63B 21/072; A63B 21/151; A63B 21/154; A63B 21/156; A63B 21/159; A63B 21/40; A63B 21/4001; A63B 21/4019; A63B 21/4021; A63B 21/4035; A63B 21/4041; A63B 21/4043; A63B 21/00061; A63B 21/00065; A63B 23/035; A63B 23/03508; A63B 23/03516; A63B 23/12; A63B 23/1245; A63B 2225/09; A63B 2225/093
See application file for complete search history.

(56) References Cited

U.S. PATENT DOCUMENTS 3,815,903 A * 6/1974 Blomqvist ..... A63B 21/06 482/103
4,027,876 A * 6/1977 Johnston ..... A63B 21/00069 242/154
4,199,139 A 4/1980 Mahnke et al.
4,317,566 A 3/1982 Uyeda et al.
4,561,154 A * 12/1985 Briscoe ..... F16G 11/046 24/136 L
4,632,388 A 12/1986 Schleffendorf
D288,451 S 2/1987 Irvine et al.
4,834,367 A * 5/1989 Salyer ..... A63B 21/156 482/100
5,195,937 A 3/1993 Engel et al.
(Continued)

*Primary Examiner* — Sundhara M Ganesan
(74) *Attorney, Agent, or Firm* — Trendak IP Law LLC; Paul N. Dunlap, Esq.

(57) ABSTRACT

A portable exercise system that can be attached to the uprights on any commonly available training rig, squat stand, or power rack, and for resistance can use any attachable weight. The system includes an upper pulley assembly, a lower pulley assembly and an anchor assembly. The anchor assembly utilizes a wedge and block to set the cable length and is adapted to attach the weights. The upper pulley assembly includes pulleys to keep the cable aligned and the resistance coming from above. The lower pulley assembly could be hinged for an additional degree of freedom. The cable runs through the lower pulleys, to the upper pulleys, and down to the anchor and weights. The other end of the cable has a fixed loop for attaching a handle for the user.

16 Claims, 5 Drawing Sheets

(56) References Cited

U.S. PATENT DOCUMENTS

| | | | | |
|---|---|---|---|---|
| 5,988,929 | A * | 11/1999 | Doan | E02F 3/60 403/374.1 |
| 5,988,941 | A * | 11/1999 | Sargent | B63C 3/06 187/372 |
| 8,096,926 | B1 | 1/2012 | Batca | |
| 8,172,733 | B1 * | 5/2012 | Batca | A63B 21/0628 482/99 |
| 8,727,952 | B1 * | 5/2014 | Carle | A63B 21/0628 482/99 |
| 2002/0154944 | A1 * | 10/2002 | Traktovenko | F16G 11/048 403/347 |
| 2003/0017918 | A1 | 1/2003 | Webb et al. | |
| 2003/0069112 | A1 * | 4/2003 | Williams | A63B 21/156 482/99 |
| 2004/0143940 | A1 | 7/2004 | Bass et al. | |
| 2007/0173384 | A1 | 7/2007 | Sechrest et al. | |
| 2009/0227432 | A1 * | 9/2009 | Pacheco | A63B 21/0628 482/101 |
| 2010/0281659 | A1 * | 11/2010 | Ciobotaru | B66B 7/085 24/485 |
| 2014/0194263 | A1 | 7/2014 | Giannelli et al. | |
| 2015/0182779 | A1 * | 7/2015 | Dalebout | F16G 11/03 403/327 |
| 2018/0221701 | A1 | 8/2018 | Hockridge | |
| 2018/0311523 | A1 * | 11/2018 | Arturo | A63B 21/4035 |
| 2019/0134450 | A1 * | 5/2019 | Kuo | A63B 21/154 |
| 2019/0240525 | A1 | 8/2019 | Leipheimer | |
| 2020/0009417 | A1 | 1/2020 | Dalebout | |
| 2020/0069988 | A1 * | 3/2020 | Gore | A63B 21/154 |
| 2020/0114195 | A1 | 4/2020 | Henniger et al. | |

* cited by examiner

MODULAR CABLE MACHINE EXERCISE SYSTEM

BACKGROUND OF THE INVENTION

This invention relates generally to a portable, modular, cable-machine, exercise system attachable to and detachable from a standard upright member of a rig, rack, or squat stand.

A traditional "functional trainer" or "cable machine" is a standalone unit that allows the user to perform pulling or pressing movements (depending on body orientation of user to machine) from different angles (e.g., from the floor up to about seven feet high) with a variety of different handles. The resistance or load is typically set with an adjustable weight stack and is transmitted through the cable to the user. These features allow the user to perform a wide array of accessory movements that target specific muscle groups that may not be as effectively activated during traditional compound movements (i.e., conventional deadlift, bench, and squat movements).

One example of such a machine is illustrated in U.S. Pat. Publication No. 2003/0017918 A1 to Webb et al. This machine allows the user to pull or push from a variety of angles as well as modify the load. Two arms are free to pivot relative to the frame in both the horizontal and vertical ranges of motion to allow for a full range of exercise movements to be performed. A variety of handles can be attached to the arms for various exercise movements.

The shortcoming of machines like this are numerous, the primary being their large footprint and high cost. With micro and home gyms becoming more prevalent, the floor space required for just one of these machines becomes impractical. The user is also limited to whatever weight increment and total load that is supplied. Additionally, while these machines can facilitate a variety of movements and weights, there are limitations in what they can do as part of a complete exercise regimen.

SUMMARY OF THE INVENTION

The present invention is directed to systems and methods which provide a portable cable machine exercise system easily attachable to and detachable from a standard upright member of a rig, rack or stand.

The exercise system includes an upper pulley assembly, a lower pulley assembly, a cable, and an anchor assembly. The upper pulley assembly and lower pulley assembly are each mountable on a standard vertical frame. The cable is attachable at one end to a handle, for example by means of a loop. The anchor assembly is attachable at the other end of the cable for adjusting the cable's working length and for attaching a resistance. With the cable threaded thru the upper pulley assembly and the lower pulley assembly, pulling on the handle is opposed by the resistance.

The resistance may be a weight, elastic element, hydraulic or pneumatic unit, or spring, provided it can be attached to the anchor assembly and thus moved or activated by the cable.

The upper pulley assembly may include an attachment member with an attachment feature compatible with the vertical frame and two pulleys arranged horizontally spaced from each other, one pulley aligned with the attachment feature and the other pulley offset horizontally from the attachment feature.

The lower pulley assembly may include an attachment member with an attachment feature compatible with the vertical frame and two pulleys arranged vertically spaced from each other. The lower pulley assembly could include a hinge.

The anchor assembly may include a wedge with two opposed, straight sides angled together toward a narrow end of the wedge, and a block with a recess shaped and sized to accept the wedge and to define a cable passage between the wedge and the block, and with an opening at the narrow end of the wedge. The anchor assembly may include a guide mechanism, which may include a protrusion on one of the block and the wedge and a slot on the other of the block and the wedge. The anchor system may include a spring biasing the wedge toward the opening in the block.

Additional pulleys, assemblies, modules or accessories could be included in various embodiments of the invention.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings, which are incorporated in and form part of the specification in which like numerals designate like parts, illustrate embodiments of the present invention and together with the description, serve to explain the principles of the invention. In the drawings.

DETAILED DESCRIPTION

The present invention is a portable exercise system that provides the pulling and pressing capabilities of conventional cable machines without the large footprint and accompanying cost. The exercise system comprises two pulley assemblies that are easily attachable to the uprights of common, commercially available training rigs, power racks, or squat stands. A cable is threaded through the pulley assemblies and terminates on one end with a loop that allows the user to attach their preferred handle. The other end of the cable terminates in an anchor assembly that allows the user to attach their preferred weight. The pulley assemblies and cable may be arranged in a variety of ways, providing different exercise modes.

Figure 1:
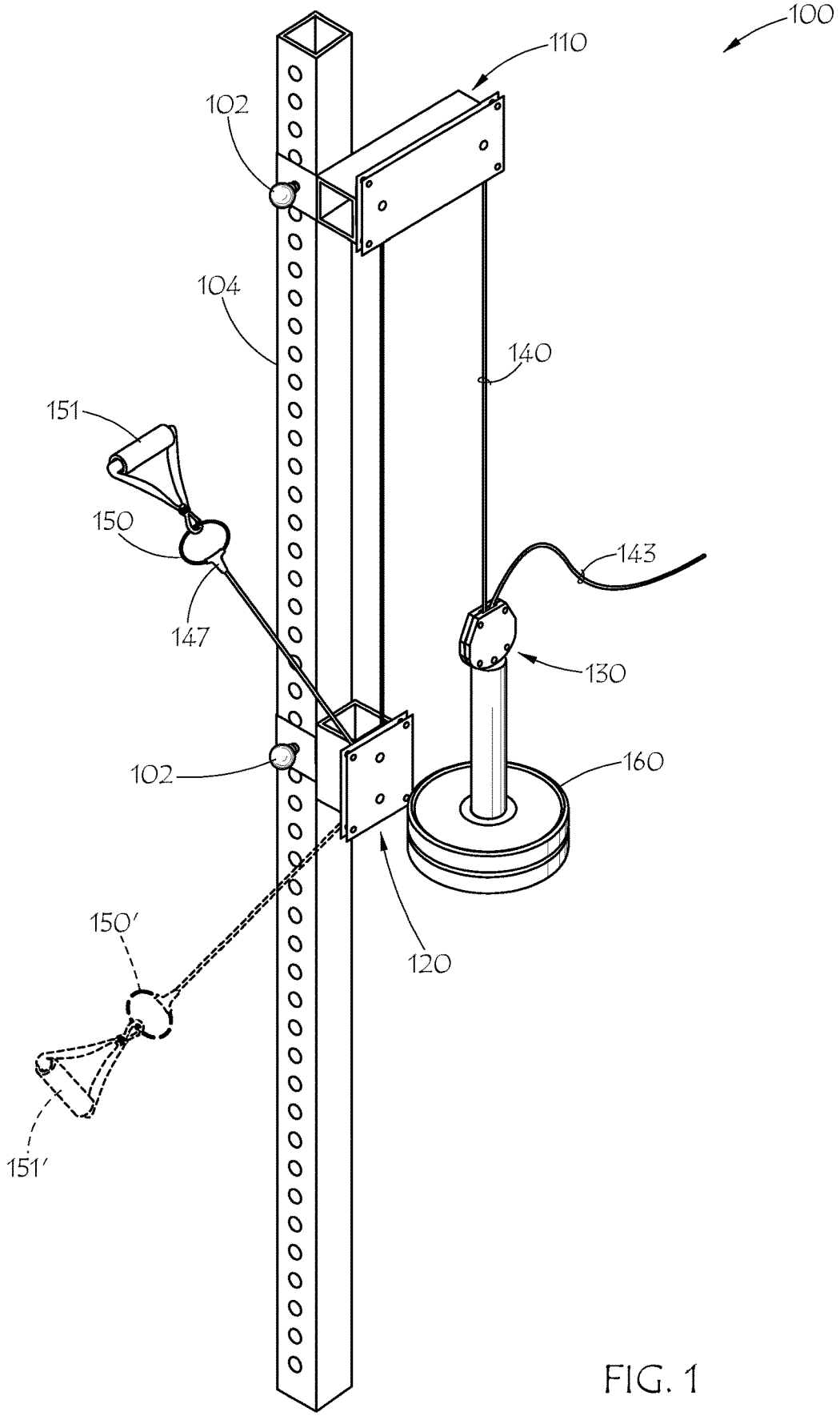
FIG. 1 is a perspective view of an embodiment of the invention.

FIG. 1 shows an embodiment of the invention in one possible arrangement. In FIG. 1, exercise system 100 includes first or upper pulley assembly 110, second or lower pulley assembly 120, anchor assembly 130, and cable 140. The upper and lower pulley assemblies are each mounted on vertical frame 104 with a corresponding fastener 102. Cable 140 is trained about pulleys in lower and upper pulley assemblies 120, 110. One end 143 of cable 140 passes through anchor assembly 130, which is adapted to clamp onto cable 140 and to attach resistance 160. The other end 147 of cable 140 terminates with a loop 150 suitable for attaching various handles. FIG. 1 shows two of many possible orientations of loop 150 and end 147 of cable 140. Loop 150 is oriented for a human user of the equipment to pull upwards against resistance 160. Loop 150' is shown in dashed lines indicating an alternate position oriented for a human user to pull downwards against resistance 160. Exemplary handle 151, 151' is shown attached to loop 150, 150'. The loop may be fixed in the cable end. Other common handle shapes or styles can be attached as desired by the user. Handles for pushing away from the frame, instead of pulling, may be used just as well.

Vertical frame 104 is representative of any conventional frame, such as training rig, power rack, or squat stand, having at least one upright or vertical post capable of such use. A steel square tube with round, regularly spaced holes for mounting accessories is illustrative and typical. Such vertical frames may be mounted to walls individually or in pairs or other combinations, or may be part a stand or free-standing rig, or permanently mounted to floor and/or ceiling or otherwise arranged.

Figure 2:
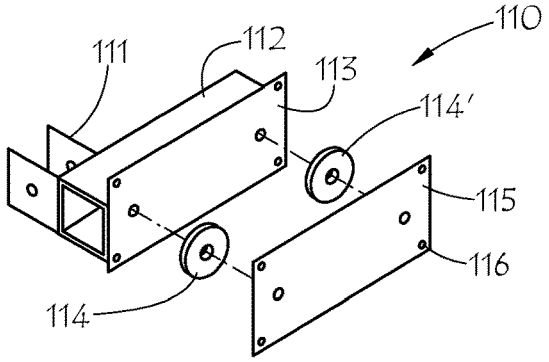
FIG. 2 is an exploded view of an upper pulley assembly.

Upper pulley assembly 110 is further illustrated in FIG. 2. Pulley assembly 110 includes attachment member 111, main body 112, pulley mounting members 113, 115, two pulleys 114, 114', and attachment sites 116 for the pulley mounting members. Pulley mounting members 113, 115 are shown as flat, rectangular plates, but they could be any desired shape. Attachment sites 116 are shown as holes adapted for threaded fasteners, but any suitable style of fastener desired can be used. Attachment member 111, main body 112, pulley mounting members 113, 115 may be formed as separate parts joined together or one or more thereof may be integrally formed. Preferably the two pulleys of the upper assembly are arranged horizontally on main body 112. Main body 112 is mounted on attachment member 111 so that one pulley 114 is in line with attachment member 111 and a vertical frame to which the assembly is to be attached, and the other pulley 114' is horizontally offset away from the vertical frame. As a result, a resistance or weight hung on a cable trained over the offset pulley 114' will be spaced away from and not interfere with the vertical frame.

Figure 3:
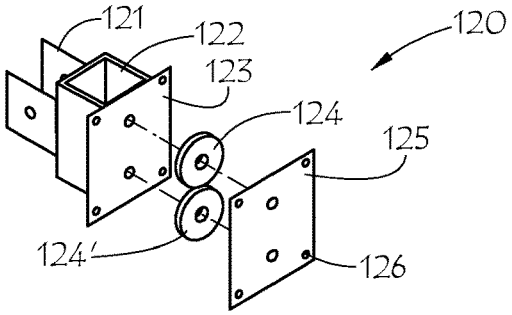
FIG. 3 is an exploded view of a lower pulley assembly.
Figure 14:
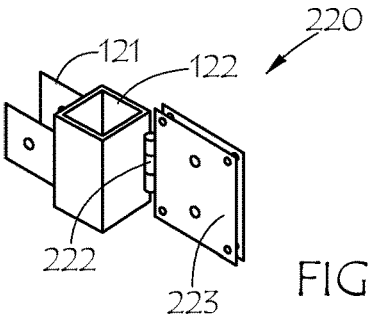
FIG. 14 is a perspective view of an alternate lower pulley assembly.

Lower pulley assembly 120 is further illustrated in FIG. 3. Pulley assembly 120 includes attachment member 121, main body 122, pulley mounting members 123, 125, two pulleys 124, 124', and attachment sites 126 for the pulley mounting members. Pulley mounting members 123, 125 are shown as flat, rectangular plates, but they could be any desired shape. Attachment sites 126 are shown as holes adapted for threaded fasteners, but any suitable style of fastener desired can be used. Attachment member 121, main body 122, pulley mounting members 123, 125 may be formed as separate parts joined together or one or more thereof may be integrally formed. Preferably the two pulleys of the lower pulley assembly are arranged vertically on main body 122. Main body 122 is mounted on attachment member 121 so that both pulleys 124, 124' are in line with attachment member 121 and a vertical frame to which the assembly is to be attached. As a result, a user pulling on a cable trained between the two pulleys 124, 124' will be able to either pull upward or horizontally with the upper pulley 124 taking the load, or to pull downward with the lower pulley 124' taking the load. A hinge could be included in a pulley assembly to add another degree of freedom of movement. FIG. 14 shows an alternate lower pulley assembly 220 with attachment member 121 on main body 122 as above, but with hinge 222 connecting body 122 and pulley unit 223 for horizontal pivoting of the pulleys with respect to the vertical upright to which it would be attached.

Figure 4:
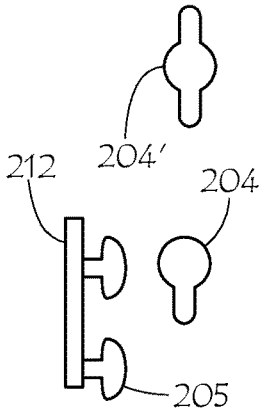
FIG. 4 illustrates an alternate attachment method.

Fastener 102 in FIG. 1 is representative of many possible attachment features or fastening systems for attaching the pulley assemblies to the upright. Fastener 102 could be a straight pin that goes through an attachment member 111, 121 on a pulley assembly 110, 120 and through matching hole(s) on vertical frame 104. The fastener could be in the form of a cotter pin, clevis pin, or quick release pin. An attachment pin could be attached to a pulley assembly in a way that makes it easy to slide the assembly onto and off of the vertical frame. FIG. 4 illustrates alternate, keyhole-shaped openings 204, 204' for a vertical frame 104. One or more mating buttons 205 could be welded onto an attachment member 212 on a pulley assembly. Another attachment style that could be used is a threaded fastener with a nut on backside of the vertical post. The threaded fastener could be separate or permanently attached to the pulley assembly. For added security, a redundant fastener can be added, or multiple mechanisms combined.

Figure 5:
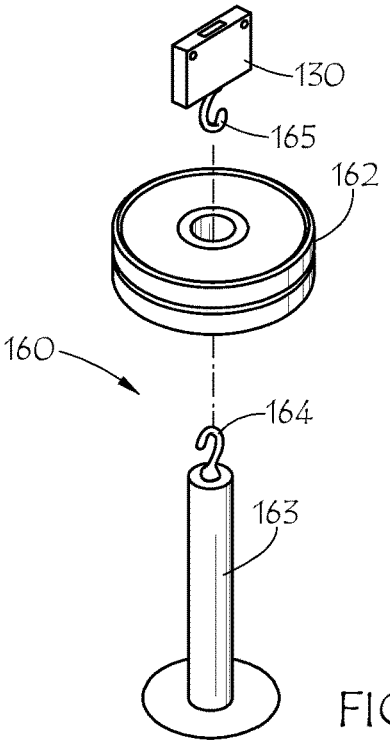
FIG. 5 is an exploded view of a resistance assembly.

Resistance 160 is representative of many possible resistance systems. Anchor assembly 130 is adapted for attachment of the user's preferred weight or resistance. Resistance 160 is further illustrated in FIG. 5 and includes weight holder 163 for mounting standard circular plates 162. Hook 164 is provided to attach to an eye or hook 165 on anchor assembly 130. Other styles of deadweights could be used instead of standard plates, for example, dumbbells, barbells, kettlebells, fatbells, or the like. Resistance 160 could alternately be provided by any form of weight that can be hung from a cable, or more particularly from the anchor assembly. Alternately, resistance 160 could be a spring member, hydraulic resistance member, or elastic member attached between anchor assembly and ground. Ground could be a rigid member attachable or attached to the vertical frame.

Figure 6:
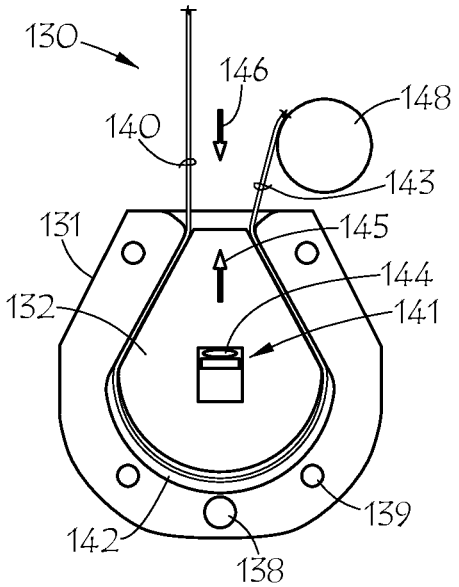
FIG. 6 is a detail view of an anchor assembly.
Figure 7:
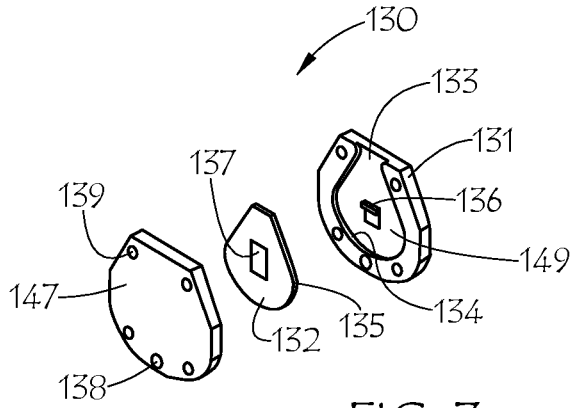
FIG. 7 is an exploded view of an anchor assembly.

The anchor assembly 130 comprises a block 131 and a wedge 132 as further illustrated in FIGS. 6 and 7. The anchor assembly allows the user to set the length of the cable. This feature allows the user to change the height of the handle end of the cable to affect the pulling or pressing angle. The wedge 132 fits inside the block 131 in a corresponding, but somewhat larger, wedge-shaped recess 149. Thus, there is a cable passage 142 between block 131 and wedge 132 sufficient for cable 140 to reside therein. The cable enters and exits the block through opening 133 at the narrow end of the wedge, passing around the wedge, exiting thru the same or a second opening, and thereby residing in passage 142. The wedge has limited movement within the block. The wedge can move away from the opening in the block in the direction of arrow 146, thus increasing the size of portions of the passage, or making the entire passage larger than the cable, and thereby allowing the cable to freely slide in and out of the block and around the wedge. The wedge can move toward the opening in the direction of arrow 145, thus tightening the linear, angled portion of the passage, wedging the cable between the wedge and the block and preventing movement of the cable. The block may include a cover 147 to retain the wedge, protect the moving parts, and possibly fulfill other design functions. Attachment sites such as holes 139 may be provided for attaching cover 147 to block 131. Hole 138 is provided for attaching resistance 160. Other suitable attachment mechanisms may be used instead or in combination with hole 138, such as clips, hooks, carabiners, threaded devices, and the like.

The wedge and the block thus work together to lock the cable in place in the corresponding passage. The wedge may contain a peripheral groove 135 for receiving the cable. The block may contain an internal peripheral groove 134 for receiving the cable. At least one of the wedge and the block may contain the peripheral groove, or both may include a groove. The groove may be shaped to receive the cable, for example a circular cable may be received in a semi-circular groove. This may maximize the frictional or gripping force on the cable. The wedge includes two opposed, straight sides angled together toward the narrow end of the wedge. The shape of the narrow end is not critical. The broad end of the wedge is curved or semi-circular, which may help prevent stress concentrations in the cable and prevent early life fatigue. Likewise, the recess in the block has two straight sides angled together toward the opening in the block. The end of the recess opposite the opening is curved or semi-circular. There is a smooth, curvilinear transition between the curved end of the recess and the two angled straight sides of the recess. The smooth transition and curvature allow a cable end to be easily inserted into the opening and pushed around and through the passage till it exits the opening. There may also be a smooth curvilinear transition between the curved end and the two angled straight sides of the wedge. When the wedge is not pushed into the tapered passageway, the cable is free to slide through the groove and thus the length of the live and dead ends can be adjusted. This allows for a long cable to be implemented and the working portion shortened or lengthened by users as their needs require.

Figure 15:
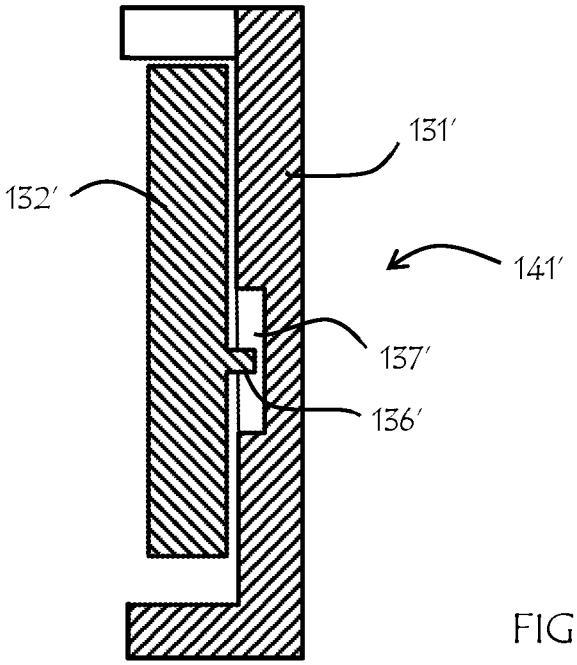
FIG. 15 is a partially fragmented sectional view of an alternate anchor assembly.

The anchor assembly could include a guide mechanism 141. The guide mechanism 141 may limit the sideways movement of the wedge within the recess to keep the passage symmetric in size on opposing angled sides of the wedge. The guide mechanism 141 may, for example, comprise a protrusion 136 which is on the block 131, and the other one of and a slot 137, one of which is on the wedge 132. The guide mechanism 141 could include a spring 144 to bias the wedge toward the opening 133 in the block so that the anchor assembly tends to grip the cable at all times. Alternately, the guide mechanism 141' shown in FIG. 15 has a protrusion 136' on wedge 132' and a slot 137' on block 131'.

Figure 8:
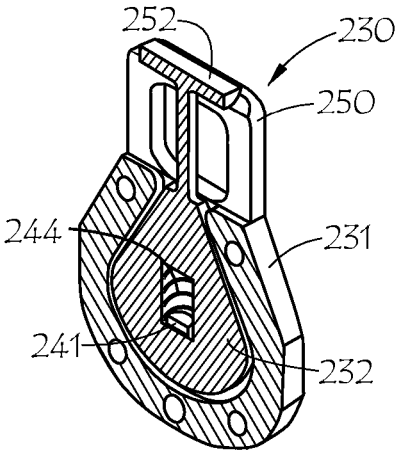
FIG. 8 is a partially fragmented view of an alternate anchor assembly.

A handle or release mechanism could be mounted on the block to overcome the spring biasing force, move the wedge away from the opening in the block, and thereby release the cable for easy insertion, removal, or length adjustment. An alternate anchor assembly with a release mechanism is shown in FIG. 8. Alternate anchor assembly 230 includes wedge 232 housed in a recess in block 231 with guide mechanism 241. Spring 244 biases the wedge toward the opening. The release mechanism includes handle 250 mounted on block 231 and plunger 252 mounted on wedge 232. Handle 250 and plunger 252 are arranged in close proximity so that a user can support the block and operate the release mechanism with one hand, leaving the other hand free to manage the cable and/or the weight. Although a T-shaped plunger is shown in FIG. 8, any suitable handle shape or plunger shape could be utilized.

Figure 9:
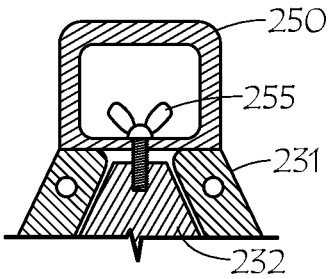
FIG. 9 is a partially fragmented view of another anchor assembly.

In another embodiment, one could replace the spring with a threaded tightener that pulls the wedge into the block to secure the cable or tighten it in the cable passage. FIG. 9 illustrates one possible arrangement with screw 255 arranged to pull wedge 232 up into block 231. The screw could be a thumb screw, wing screw, or other easily manipulated, hand-operated screw mechanism which, in combination with handle 250, should make it possible to tighten or loosen screw 255 with one hand.

When the cable is fitted around the wedge and the wedge is pushed into the tapered passageway, the cable passes around the wedge such that a live or working end of rope and a dead or non-working end of rope extend out of the open end of the block from opposite sides of the wedge. The live end of the cable extends through the pulley system and terminates with the user handle, whereas the dead end of the rope does not bear a load and could be wrapped up in reel or take-up device 148, which could be a spring-loaded take-up or receiver.

The anchor mechanism should be made from material that will be strong enough to handle the cable loads but will not be too slippery for the cable to be clamped in place. Furthermore, the cable should have the tensile strength to facilitate the loads being moved and should not be so smooth as to not be clamped effectively. The surface texture of both the wedge and anchor could be adjusted to increase friction or gripping ability.

The cable could be any material capable of handling the weights or resistance to be used. Preferably the cable is steel, but aramid, carbon fiber, or other synthetic fibers or hybrids may be used. The cable could be coated with a protective material, such as a thermoplastic polymer or rubber. The cable is preferably round, but it could be non-round, such as flat, oval, or the like. The cable could be a belt or belting, such as a flat belt, round belt, or the like. The cable could be a chain.

The dual pulley system allows for the user to change the height, and subsequently angle, of the pulling or pressing motion. So long as the horizontal unit stays mounted above the vertical unit, they can be spaced as close together or far apart (but keeping the pulleys in the same plane) and still function appropriately, i.e., in the same way shown in FIG. 1. Typically, the cable runs through the lower pulley assembly, up to the upper pulley assembly, and down to the anchor assembly and weight. The upper assembly is preferably mounted high enough that all desired pull angles can be attained by simply moving the lower pulley assembly up or down on the upright.

It should be noted that there are a variety of commercially available handle attachments that allow for two-handed applications with this exercise system. While FIG. 1 shows a single cable system, two systems could be attached to adjacent uprights to allow for bilateral pulling of two independent resistances.

When not in use, the system components can be easily removed from the upright and stored out of the way so the rack/rig/stand can still maintain other, conventional functionality.

Assemblies may be made of heavy-duty materials, with large dimensions typical of professional, Olympic, or extreme-performance lifting. Alternately, the assemblies may be downsized, designed for amateur or lower levels of performance with reduced component weight and lower cost. One can line or coat the inside of attachment or contact points with UHMWPE (ultra-high-molecular-weight polyethylene) or other non-abrasive or protective material to protect the surface finish of the upright.

Other additions or features may be included. One may add handles to the upper and/or lower pulley assemblies to make them easier to adjust and move. Upper and lower assemblies may nest together, for example with a slot/tab style design, so that the cable may be threaded through the system more easily before adjusting to separate locations on the upright. Cable stabilizers may be added, such as a pin with an eyelet that acts as a cable guide to keep the weight from swinging. One could add a hinge on the lower assembly to add another degree of freedom as shown in FIG. 14.

Figure 10:
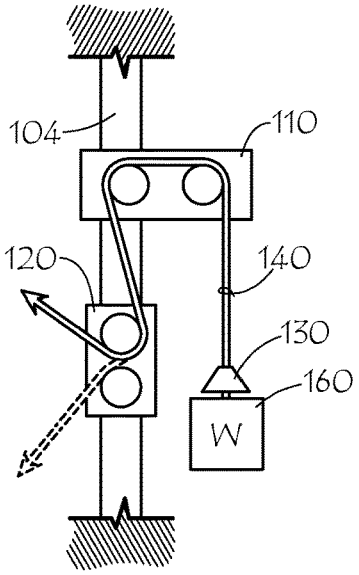
FIG. 10 is a schematic of an embodiment of the invention.
Figure 11:
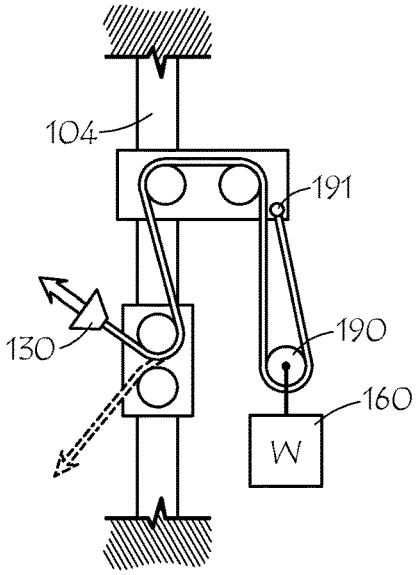
FIG. 11 is a schematic of another embodiment of the invention.

Other system arrangements can be accomplished with the system components and possibly with additional similar components. FIGS. 10-13 illustrate various possible arrangements or embodiments of the invention. FIG. 10 shows the arrangement of FIG. 1 with the same parts of the system using the same numbering. FIG. 11 shows an alternate arrangement with the anchor assembly replaced by a single pulley 190 attached to the weight 160 or "W". The cable passes around pulley 190 and is fixed to the upper pulley assembly or to the rack at 191. Thus, the embodiment of FIG. 11 results in a change in the pulling ratio and force required to hoist the weight. FIG. 11 also illustrates that the anchor assembly 130, with its ability to adjust the cable length could be moved to the handle end of the cable.

Figure 12:
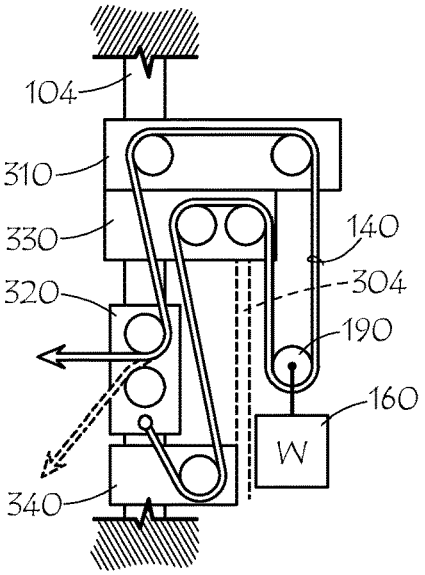
FIG. 12 is a schematic of another embodiment of the invention.

The embodiment of FIG. 12 includes the pulley 190 and weight W as in FIG. 11, along with pulley assemblies 310, 320, 330, and 340 arranged so that the cable makes a complete circuit from pulley assembly 320 around to the weight and back to the pulley assembly 320. Thus, when pulley assembly 320 is adjusted up or down the vertical frame, the length of the cable route does not change. This could allow for elimination of the anchor assembly or the need to adjust cable length. On the other hand, the anchor assembly could still be used for changing the length of the handle end of the cable for different exercises.

Figure 13:
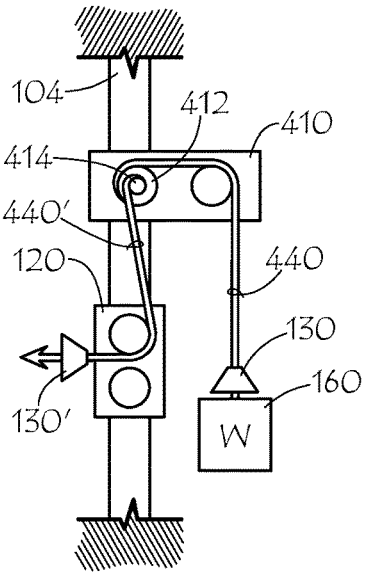
FIG. 13 is a schematic of another embodiment of the invention.

The embodiment of FIG. 13 includes a two-cable system for changing the pull ratio. Cable 440 attaches to the anchor assembly 130 at one end, to which weight W is attached. The other end of cable 440 winds onto a first geared pulley 412 on upper pulley assembly 410. The second cable 440' runs from a second anchor assembly 130' to which the user's handle may be attached, to wind onto a second geared pulley 414 on upper pulley assembly 410. First geared pulley 412 and second geared pulley 414 are of different diameters but are fixed on a common shaft and rotate together. The result is a change in the pull ratio between handle and weight movement. Each of the two cables may be wrapped around its corresponding pulley multiple times to provide sufficient range of motion of the handle end and the weight. Alternately, a single cable could be used if a passage is provided for the cable to transition from one pulley to the other, and a locking feature is provided to prevent the cable slipping with respect to the pulley.

One could include a vertical rail in the inventive system. Then two or more of the pulley assemblies could be mounted on the rail and the rail attached or mounted on a rig, rack, or stand. For example, in FIG. 12, upper assemblies 310, 330 could be mounted on rail 304 (shown in phantom lines) with lower assembly 340 so that they all move together or get fixed in place together. Then lower assembly 320 can be moved independently of the other fixed assemblies, thus maintaining the length of the cable route. Other accessories or other assemblies can be added to the vertical 104 or the rail 304 to complete the system.

Although the present invention and its advantages have been described in detail, it should be understood that various changes, substitutions, and alterations can be made herein without departing from the scope of the invention as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps. The invention disclosed herein may suitably be practiced in the absence of any element that is not specifically disclosed herein.

What is claimed is:

1. An exercise system comprising an upper pulley assembly, a lower pulley assembly, a cable, and an anchor assembly;

the upper pulley assembly and lower pulley assembly each mountable on a standard vertical frame;

the cable including a loop at one end for attaching a handle;

the anchor assembly attachable at the other end of the cable for adjusting the cable's working length and for attaching a resistance, said anchor assembly comprises: a wedge comprising two opposed, straight sides angled together toward a narrow end of the wedge; and a block having a recess shaped and sized to accept the wedge and to define a cable passage between the angled sides of the wedge and the block, and with an opening in the block at the narrow end of the wedge;

so that with the cable threaded through the upper pulley assembly and the lower pulley assembly, pulling on said handle is opposed by said resistance.

2. The exercise system of claim 1 wherein said resistance is a weight.

3. The exercise system of claim 1 wherein said upper pulley assembly comprises:

an upper main body with an upper attachment member with a fastener compatible with the vertical frame; and a first pair of pulleys arranged horizontally spaced from each other on the upper main body so that when the upper pulley assembly is mounted on said vertical frame, one pulley is aligned with said vertical frame and the other pulley is offset horizontally from said vertical frame.

4. The exercise system of claim 3 wherein said lower pulley assembly comprises:

a lower attachment member with a fastener compatible with the vertical frame; and a second pair of pulleys arranged vertically spaced from each other.

5. The exercise system of claim 4 wherein said anchor assembly further comprises a guide mechanism.

6. The exercise system of claim 5 wherein said guide mechanism comprises a protrusion on one of the block and the wedge and a slot on the other of the block and the wedge.

7. The exercise system of claim 6 wherein said anchor assembly further comprises a spring biasing the wedge toward the opening in the block.

8. The exercise system of claim 7 wherein said anchor assembly further comprises a release mechanism that overcomes the spring biasing and moves the wedge away from the opening in the block.

9. The exercise system of claim 4 wherein the anchor assembly further comprises a hand-operated screw mechanism that tightens the cable in the cable passage.

10. The exercise system of claim 1 wherein said lower pulley assembly comprises:

a lower attachment member with a fastener compatible with the vertical frame; and a second pair of pulleys arranged vertically spaced from each other.

11. The exercise system of claim 10 wherein the lower pulley assembly further comprises a hinge.

12. The exercise system of claim 1 wherein said anchor assembly further comprises a guide mechanism.

13. The exercise system of claim 12 wherein said guide mechanism comprises a protrusion on one of the block and the wedge and a slot on the other of the block and the wedge.

14. The exercise system of claim 13 wherein said anchor assembly further comprises a spring biasing the wedge toward the opening in the block.

15. The exercise system of claim 14 wherein said anchor assembly further comprises a release mechanism that overcomes the spring biasing and moves the wedge away from the opening in the block.

16. The exercise system of claim 1 wherein the anchor assembly further comprises a hand-operated screw mechanism that tightens the cable in the cable passage.

* * * * *